US007290363B2

(12) United States Patent
Turnwald

(10) Patent No.: US 7,290,363 B2
(45) Date of Patent: Nov. 6, 2007

(54) NAPKIN RING

(76) Inventor: Hans A. Turnwald, 2893 SW. 69 Ct., Miami, FL (US) 33155

( * ) Notice: Subject to any disclaimer, the term of this patent is extended or adjusted under 35 U.S.C. 154(b) by 210 days.

(21) Appl. No.: 11/249,607

(22) Filed: Oct. 13, 2005

(65) Prior Publication Data

US 2007/0094908 A1 May 3, 2007

(51) Int. Cl.
*A44C 25/00* (2006.01)

(52) U.S. Cl. ..... 40/642.02; 63/33; D7/72

(58) Field of Classification Search ..... 24/7, 24/8, 9; 40/124.4, 642.02, 658, 661.05; D7/631, D7/632, 633, 634
See application file for complete search history.

(56) References Cited

U.S. PATENT DOCUMENTS 155,237 A * 9/1874 Sanders ..... 310/154.23
1,515,238 A * 11/1924 Baker ..... 225/43
1,527,024 A * 2/1925 Brookbank ..... 40/493
3,106,314 A * 10/1963 Spears ..... 221/35
3,965,591 A 6/1976 Le Sueur
D242,419 S 11/1976 Stamatovich
4,494,718 A * 1/1985 Clay ..... 248/694
D356,235 S 3/1995 Yee
5,487,924 A 1/1996 Fritz
D398,490 S * 9/1998 Drakin et al. ..... D7/702
6,073,798 A * 6/2000 Rosenhain ..... 220/736
6,694,779 B1 2/2004 Dreger

OTHER PUBLICATIONS http://web.archive.org/web/20050205165831/http://www.bridalpeople.com/placecard-holders/9870.asp BridalPeople, Place Card Holder/Mini Vase- Set of 6, Feb. 5, 2005.*
http://www.goantiques.com/detail,rare-cherub-bud,1158595.html?source=VYZ4474 GoAntiques, RARE Cherub with Bud Vase Napkin Ring Silverplate—Antique Victorian Silverplate, late 1800s.*

* cited by examiner

*Primary Examiner*—Lesley D. Morris
*Assistant Examiner*—Shin Kim
(74) *Attorney, Agent, or Firm*—Ruben Alcoba, Esq.

(57) ABSTRACT

A napkin ring composed of a napkin holder and a receptacle. The receptacle holds a decorative element and further defines a slit for holding a card. The card is used to display information to an end user.

3 Claims, 3 Drawing Sheets

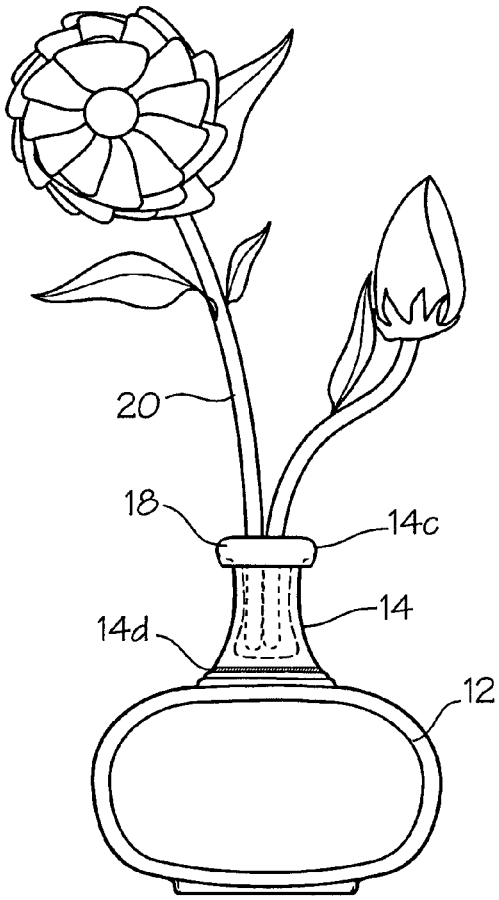
Fig. 5A
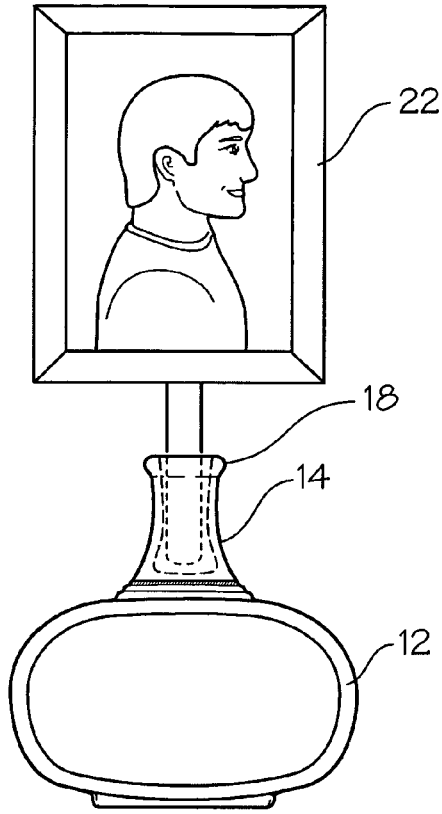
Fig. 5B
Fig. 5C
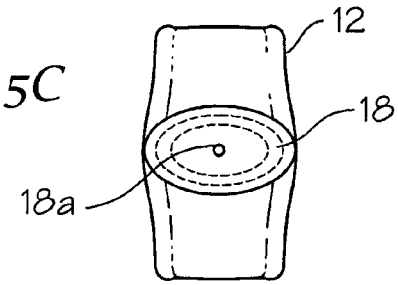

NAPKIN RING

BACKGROUND

Napkin rings have been used to display ornamental designs in the past. Their functionality has normally been restricted by the space of the ring. The object of this invention is to provide a stable ornamental display that can hold business cards or any other type of cards, while allowing an ornamental display to be housed within a receptacle of the napkin ring. This invention further allows the ornamental display to be a fresh flower that can be placed within a receptacle.

SUMMARY

The present invention is directed to a napkin holder that can deliver specific details to an end user of the napkin holder in a sophisticated manner. The napkin holder is a decorative piece that serves the dual purpose of being a card holder. The napkin ring comprises a napkin holder, having top and bottom sides, wherein the bottom side of napkin holder is a flat surface, and a receptacle, having top and bottom sides, wherein the top side of receptacle defines a lip and adjacent the bottom side of receptacle a slit is defined, the bottom side of receptacle attaches top side of napkin holder. The napkin ring might further comprise of a card that attaches within the slit of the receptacle.

In another embodiment of the present invention, the napkin ring can further comprise of a gasket that attaches to lip of the receptacle, wherein the gasket has a perforation therein, and an element, having two ends, that is placed through the gasket's perforation so that one end of the element lays within the receptacle and the other end of the element lays outside of the receptacle. The element may be a fresh flower or any other decorative piece.

An object of this invention is to allow a card to be displayed on a napkin ring, the card being used to inform a person sitting in front of the napkin holder of a specific detail.

A further object of this invention is to allow a fresh flower to be placed within a receptacle of a napkin holder. The fresh flowers life span might be extended by providing a liquid within the receptacle of the napkin holder.

Another object of this invention is to place an element within the receptacle of a napkin holder.

DRAWINGS

These and other features, aspects, and advantages of the present invention will become better understood with regard to the following description, appended claims, and accompanying drawings where:

Figure 1:
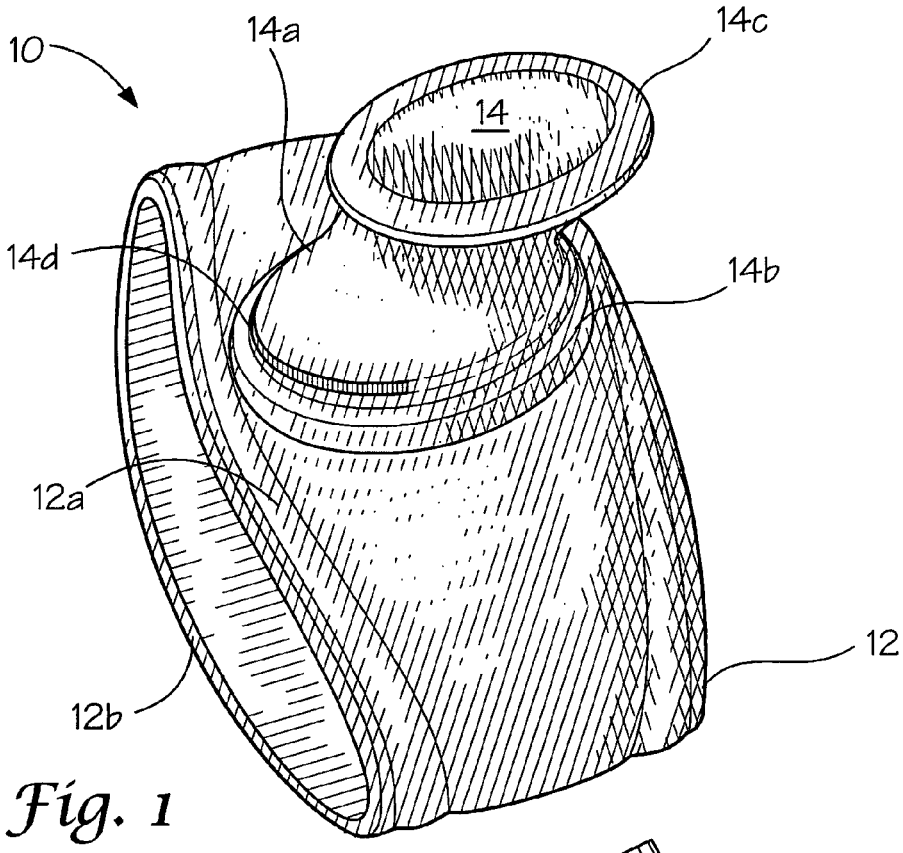
FIG. 1 shows a perspective view of a napkin ring.

FIG. 5*a* shows the napkin ring of FIG. 1 having a gasket covering the lip of the receptacle of the napkin holder, and wherein the stem of a flower is placed through a perforation of the gasket and the stem is made to rest within the receptacle;

FIG. 5*b* shows a variation of FIG. 5*a*, wherein a picture holder is placed through the perforation of the gasket; and FIG. 5*c* shows a top view of the napkin ring, wherein the gasket and the perforation are displayed.

DESCRIPTION

Figure 2:
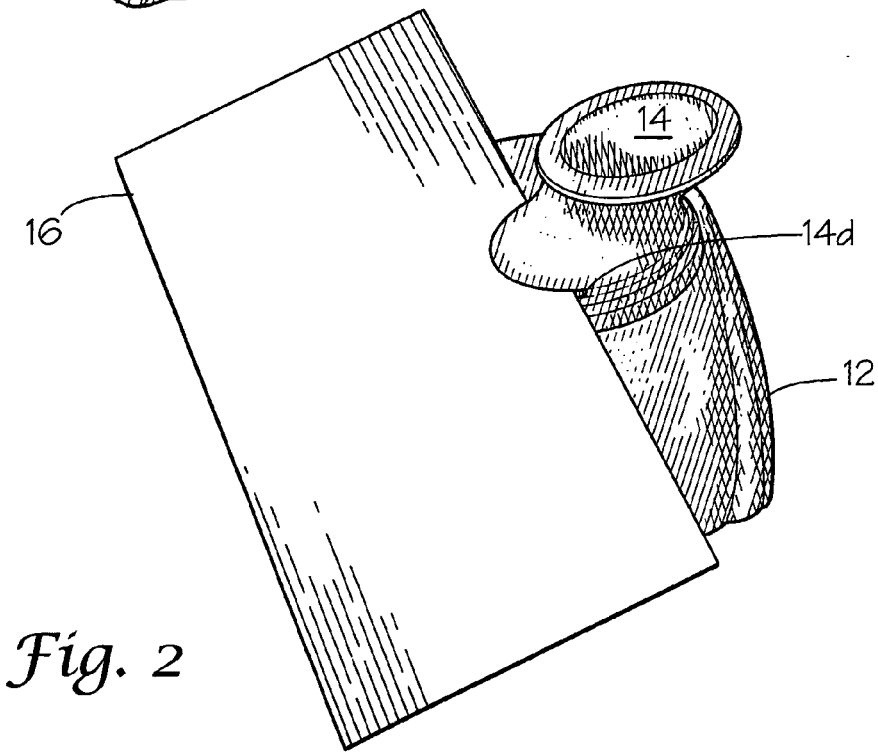
FIG. 2 shows the napkin ring of FIG. 1 with a card holder attached therein.
Figure 3:
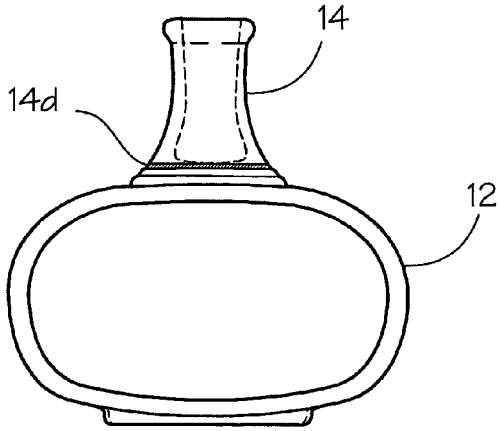
FIG. 3 shows a side view of the napkin holder of FIG. 1.
Figure 4:
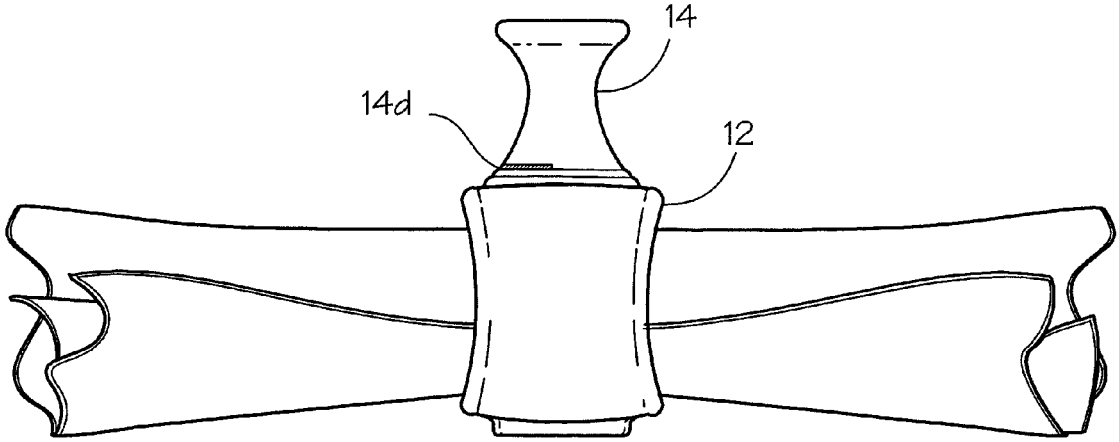
FIG. 4 shows the napkin ring of FIG. 1 with a napkin therein.

As seen in FIG. 1, a napkin ring 10 comprises a napkin holder 12, having top 12*a* and bottom 12*b* sides, wherein the bottom side 12*b* of napkin holder 12 is a flat surface; and a receptacle 14, having top 14*a* and bottom 14*b* sides, wherein the top side 14*a* of receptacle 14 defines a lip 14*c* and adjacent the bottom side 14*b* of receptacle 14 a slit 14*d* is defined, the bottom side of receptacle 14*b* attaches top side of napkin holder 12*a*. As Seen in FIG. 2, the napkin ring 10 might further comprise a card 16 that attaches within the slit 14*d* of the receptacle 14.

As seen in FIGS. 5*a-c*, in another embodiment of the present invention, the napkin ring 10 might further comprise of a gasket 18 that attaches to lip 14*c* of the receptacle 14, wherein the gasket 18 has a perforation 18*a* therein, and an element 20/22, having two ends, placed through the gasket's perforation 18*a* so that one end of the element 20/22 lays within the receptacle 14 and the other end of the element 20/22 lays outside of the receptacle 14.

The gasket 18 shown in FIGS. 5*a-c* is made of any material having the similar properties to rubber or silicone.

The element 20/22 might be a fresh flower 20 or any other decorative piece, for example a picture frame 22. When using a fresh flower 20, the user of the napkin holder 10 might place fresh water within the receptacle 14 prior to sealing the receptacle 14 with a gasket 18.

This invention is used by placing a napkin within the napkin holder 10, then placing the gasket 18 over the lip 14*c* of the receptacle 14, then placing an element within the perforation of the gasket, and then placing a card 16 within the slit of the receptacle. It is foreseeable that the user of the above invention might do the above steps in a different order.

In another embodiment of the present invention, the element 20/22 is placed directly within the receptacle 14 without the need of placing the gasket 18 over the lip 14*c* of the receptacle 14.

An object of this invention is that it allows a card to be displayed on a napkin ring, the card being used to inform a person sitting in front of the napkin holder of a specific detail.

A further object of this invention is that it allows a fresh flower to be placed within a receptacle of a napkin holder. The fresh flowers life span is extended placing a liquid within the receptacle of the napkin holder.

Another object of this invention is that it allows the user to place an element within the receptacle of a napkin holder.

Although the present invention has been described in considerable detail with reference to certain preferred versions thereof, other versions are possible. Therefore the spirit and the scope of the claims should not be limited to the description of the preferred versions contained herein.

What is claimed is:

1. A napkin ring comprising:

a napkin holder, having top and bottom sides, wherein the bottom side of napkin holder is a flat surface;

a receptacle, having top and bottom sides, wherein the top side of the receptacle defines a lip and adjacent the bottom side of the receptacle defines a slit, the bottom side of the receptacle attaches to the top side of the napkin holder;

a card that attaches within the slit of the receptacle;

a gasket that attaches to lip of the receptacle, wherein the gasket has a perforation therein; and an element, having two ends, placed through the gaskets perforation so that one end of the element lays within the receptacle and the other end of the element lays outside of the receptacle.

2. The napkin ring of claim 1, wherein the element is a fresh flower.

3. The napkin ring of claim 2, wherein a liquid is placed within the receptacle prior to attaching the gasket to the lip of the receptacle.

* * * * *